United States Patent [19]

Schroeder

[11] Patent Number: 5,024,137

[45] Date of Patent: Jun. 18, 1991

[54] FUEL ASSISTED ELECTROMAGNETIC LAUNCHER

[76] Inventor: Jon M. Schroeder, 14301 Bagdad Rd., Leander, Tex. 78641

[21] Appl. No.: 435,616

[22] Filed: Nov. 13, 1989

[51] Int. Cl.[5] ..... F41B 6/00

[52] U.S. Cl. ..... 89/8; 124/3; 244/63

[58] Field of Search ..... 89/8; 124/3; 244/63; 310/12, 14; 318/135

[56] References Cited

U.S. PATENT DOCUMENTS

| | | | |
|---|---|---|---|
| 3,206,652 | 9/1965 | Monroe | 124/3 |
| 4,432,333 | 2/1984 | Kurherr | 89/8 |
| 4,714,003 | 12/1988 | Kemeny . | |
| 4,718,322 | 1/1988 | Honig et al. . | |
| 4,745,350 | 5/1988 | Long et al. | 323/340 |
| 4,753,153 | 6/1988 | Jasper, Jr. . | |
| 4,754,687 | 7/1988 | Kemeny . | |
| 4,791,850 | 12/1988 | Minovitch . | |
| 4,796,511 | 1/1989 | Eyssa . | |
| 4,817,494 | 4/1989 | Cowan . | |

FOREIGN PATENT DOCUMENTS

| | | | |
|---|---|---|---|
| 1903959 | 8/1970 | Fed. Rep. of Germany | 89/8 |
| 2829747 | 1/1980 | Fed. Rep. of Germany | 124/3 |

OTHER PUBLICATIONS

Zabar et al., "Power Conditioner for a Coil-Gun", Sixth IEEE Pulsed Power Conference, Jun. 29-Jul. 1, 1987, pp. 29-32.

Park et al., "Ablation and Deceleration of Mass Driver-Launched Projectiles for Space Disposal of Nuclear Wastes", AIAA 19th Aerospace Sciences Meeting, Jan. 12-15, 1981, pp. 201-225.

Winterberg, F., "The Electromagnetic Rocket Gun-A Novel Launch Concept", IEEE Transactions on Magnetics, vol. Mag-20, No. 2, Mar. 1984, pp. 370-372.

*Primary Examiner*—Stephen C. Bentley

*Attorney, Agent, or Firm*—Joseph F. Long

[57] ABSTRACT

A fuel assisted electromagnetic launcher wherein a payload is contained in a forward portion of a pointed cylindrical launch container and rocket fuel is contained in a rearward portion; and wherein a launch preparation unit in the launcher cools and heats alternate junctions in circular disposed thermopiles around the cylindrical launch container; and wherein electrical coils encased in plastic form a cylindrical barrel. With the coils with spacers in between each containing a photoelectric detector charged by an external D.C. voltage source electrical fields from the coils interact with the electrical fields around the launch container when the launch container is propelled into the cylindrical barrel by ignition of the rocket fuel; the interaction being caused by the magnetic wave field successively generated in the coils as the ablative tip of the launch container approaches each coil and thereby activates thru the photoelectric detector in the spacer a Mos-Fet switch or a similar nano-second switch to open a switch in the D.C. charged coil circuit between the D.C. voltage source and a capacitor connected across the inlet and exit leads of each of the coils.

16 Claims, 3 Drawing Sheets

FUEL ASSISTED ELECTROMAGNETIC LAUNCHER

This invention is being especially adapted for Defense under Federally Sponsored Research grants.

BACKGROUND OF THE INVENTION

With increasing interest in use of space for both defense and commercial use, such as communication satellites there exists a need for a safe, lower cost way to launch various payloads into space. The objectives of this invention include a launcher that is:

a) economical to use and simple to operate,
b) safe,
c) variable in size,
d) portable,
e) operable repeatedly and rapidly The invention as outlined in these claims and specifications achieves these objectives.

There are a large number of patents in this field with those we find that are generally most closely related to this invention being listed below:

| Ser. No. | Inventor | Date |
|---|---|---|
| 4,817,494 | Maymard Cowan | 4/4/1989 |
| 4,796,511 | Yehia M. Eyssa | 1/10/1989 |
| 4,791,850 | Michael A. Minovitch | 12/20/1988 |
| 4,754,687 | George A. Kemeny | 7/5/1988 |
| 4,753,153 | Louis J. Jasper, Jr. | 6/28/1988 |
| 4,718,322 | Emanual M. Honig, et al. | 1/12/1988 |
| 4,714,003 | George A. Kemeny | 12/22/1989 |

The general approach or general principles in these patents are discussed in August 1987 Popular Science, pages 54 through 58, a copy of which is attached.

This invention uniquely differs from publications and patents we have seen in several aspects, including:

(1) a launchable container that has a means to generate spaced magnetic field rings and that is both initially accelerated and finally accelerated with rocket fuel,
(2) a secondary acceleration means comprising electromagnetic propellant rings which are chargeable by a D.C. power source and which interact with the spaced magnetic field producing rings on the launchable container in a manner to make maximum use of the electro-magnetic energy,
(3) a choice of the number of electromagnetic propellant rings with capacitor means to vary the frequency of interacting fields to allow a wide range of different launch velocities to be achieved in a very short time span with a velocity check means to abort a launch if a preset velocity is not reached internally at an internal check point.
(4) use of low cost, readily available materials all of which are easily handled safely.

SUMMARY OF THE INVENTION

The invention may use chemical energy in the form of rocket fuel or similar propellant means such as an explosive charge for initial acceleration of a payload encased in a pointed cylindrical hull having thermopile bands spaced to interact with electromagnetic propelling flux rings. After rocket ignition or other initial acceleration, the cylindrical hull is both guided and accelerated through the center portion of a tube formed with electromagnetic propelling flux rings or propellant coils that are D.C. charged and electromagnetically increase the speed of the cylindrical hull when N-S-N-S etc. magnetic fields created around the thermopile bands around the pointed cylindrical hull or container and the magnetic flux created around the electromagnetic propellant coils interact. The pointed portion of the cylindrical hull activates a nano-second switch photoelectrically to open a circuit in one side of the D.C. charged propellant coils to create an alternating or "ringing" magnetic flux field. Proper spacing of the electromagnetic propelling or propellant coils and the thermopile bands around the pointed cylindrical hull and variation of the frequency of the alternating magnetic flux field is essential for maximum performance.

The rocket fuel used for initial acceleration continues to burn to provide extra thrust to propel the cylindrical hull into outer space. This is a necessary part of the invention since friction with air could consume the cylindrical hull if the cylindrical hull leaves the end of the propellant system at speeds much greater than about 5 miles per second. This problem is minimized at high altitudes. Inertia of the cylindrical hull plus the momentum of unburned fuel plus the reactive force from the rocket fuel may be chosen to increase the velocity to propel the hull, also referred to as a cylindrical launch container, into outer space.

BRIEF DESCRIPTION OF THE DRAWINGS

FIG. 6 is opened. Changing the size of the variable sized capacitors 6, FIG. 6 varies this frequency to allow maximum use for the electrical energy for acceleration.

DETAILED DESCRIPTION OF THE INVENTION

Figure 1:
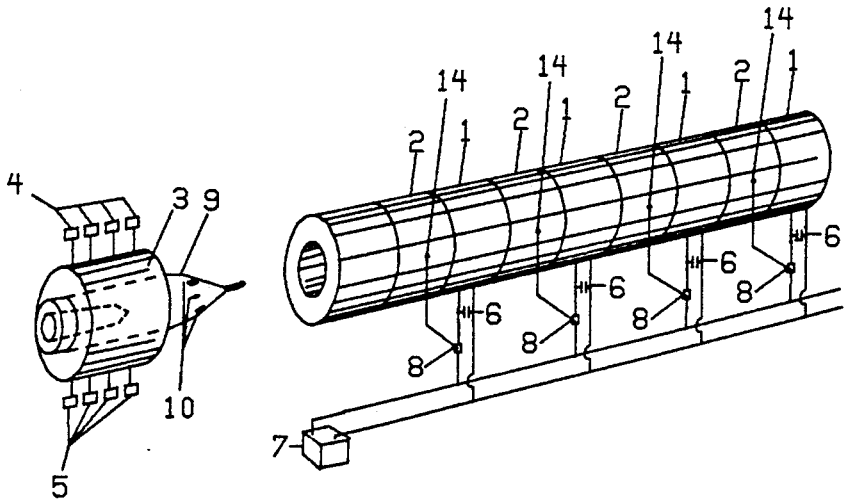
In FIG. 1 we show a perspective view indicating the cylindrical launch container with a cone shaped front portion 9 with a holding structure 3 and a succession of spacers 2 with electromagnetic propellant coils 1 with attendant peripherals that comprise the gun barrel-like electromagnetic propellant system.

An overall view of the hardware of the invention is briefly shown in FIG. 1. Propellant rings 1, also referred to as electromagnetic propellant rings, are made of multiple turns of insulated conductive wire such as copper, wound in a coil with a square cross section and potted in a hard resin. Spacer rings 2 are made of a non-conducting material in a similar shape. We've indicated photoelectrical cells 14 in some of the spacer rings 2. Spacer rings 2 and coils 1 are arranged in a gun barrel-like configuration. Leads from propellant ring 1 lead through a nano-second switch 8 such as a Power Mos-fet switch to a D.C. source 7. A capacitor 6 is across the leads going to the power source. Differing size capacitors 6 vary the frequency of the "ringing" type circuit caused when switch 8 is opened. The cylindrical launch container 9 with retractable guidance fins 10 may be held in a mounting tube 3. The mounting tube 3 serves to position the launch container 9 and also to hold a heating element 4 which could be an electrical heater, or a flame, and a cooling means 5 which preferably is liquid nitrogen but any of various cooling means such as refrigeration or liquid carbon dioxide or dry ice of FREON or liquid ammonia could be used.

Figure 2:
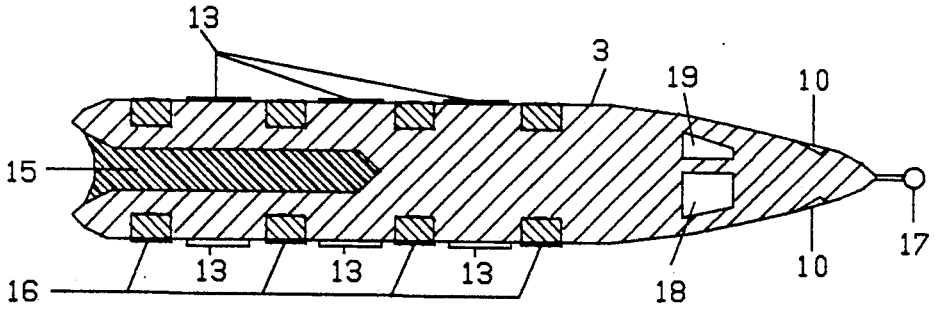
In FIG. 2 we show a side view of the cylindrical container 3 that is to be launched with thermopile rings 16 and propellant fuel containing compartment 15.

In FIG. 2 we show one of the most simple versions of the cylindrical launch container 9. Junctions of thermopile rings 16 are alternately heated by heater means 4, FIG. 1, and cooled by cooling means 5, FIG. 4, to activate the thermopile ring. When the launch container 9 leaves the mounting tube 3 flow of current in the thermopile rings 16 create alternate N-S magnetic fields. Also shown is an ablatable tip 23 of a length that properly times opening of nano-second switch 8, FIG. 1, by activating photoelectrical cell 14, FIG. 1 by interference of tip 17 with a light path of the photoelectric cell 14, FIG. 1. Rocket fuel 15 preferably of a solid type is contained in a rearward compartment. Also indicated are silicon wafer, sunlight to electricity converters 13 with an inertial guidance system 18 and a remote control guidance system 19. These may be activated to change three different retractable fins 10 that effectively change the shape of the one shaped nose 10.

Figure 3:
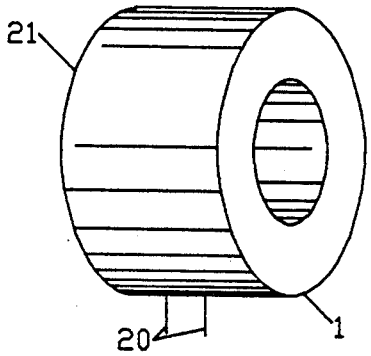
In FIG. 3 and FIG. 4 we show more detail of electromagnetic propellant coils 1 showing a cross section indicating shape of insulated wire coil 25 in potting material 21.

FIG. 3 indicates the shape of propellant rings 1 with the casing formed by outer surface of potting material 21 with dual leads 20 for each propellant coil.

Figure 4:
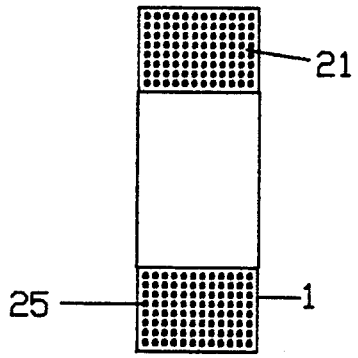

FIG. 4 shows cross section showing windings of insulated wire 25 forming propellant coil 1.

Figure 5:
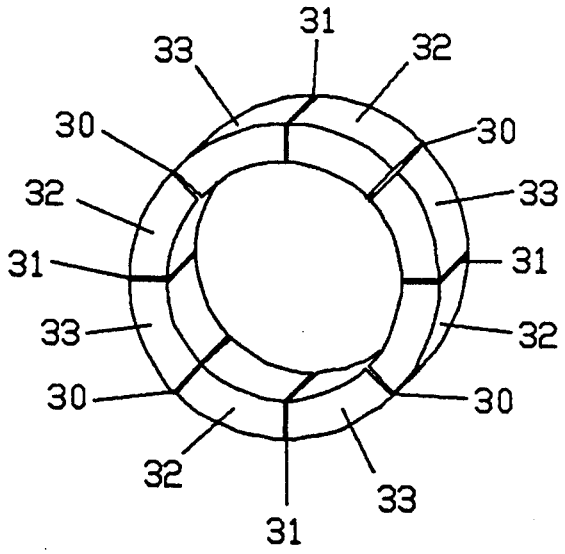
In FIG. 5 we show more detail of the segmented thermopile rings 16 indicating junctions to be heated 30 and junctions to be cooled 31. Segment 32 is chosen from one of a group comprising nickel, constantan, and ALUMEL, aluminum alloy and segment 33 is chosen from one of a group comprising copper, silver, brass, aluminium and iron. Choices of material are based on need for maximum voltage, maximum conductance and minimum weight.

FIG. 5 shows the make-up of one of the thermopile rings. These rings are preferably made with a solid square segment of aluminum brazed to a solid square segment of nickle. Segments are bent to form a ring and alternate functions are heated and alternate junctions cooled to cause a continual electron flow around the ring so formed.

Figure 6:
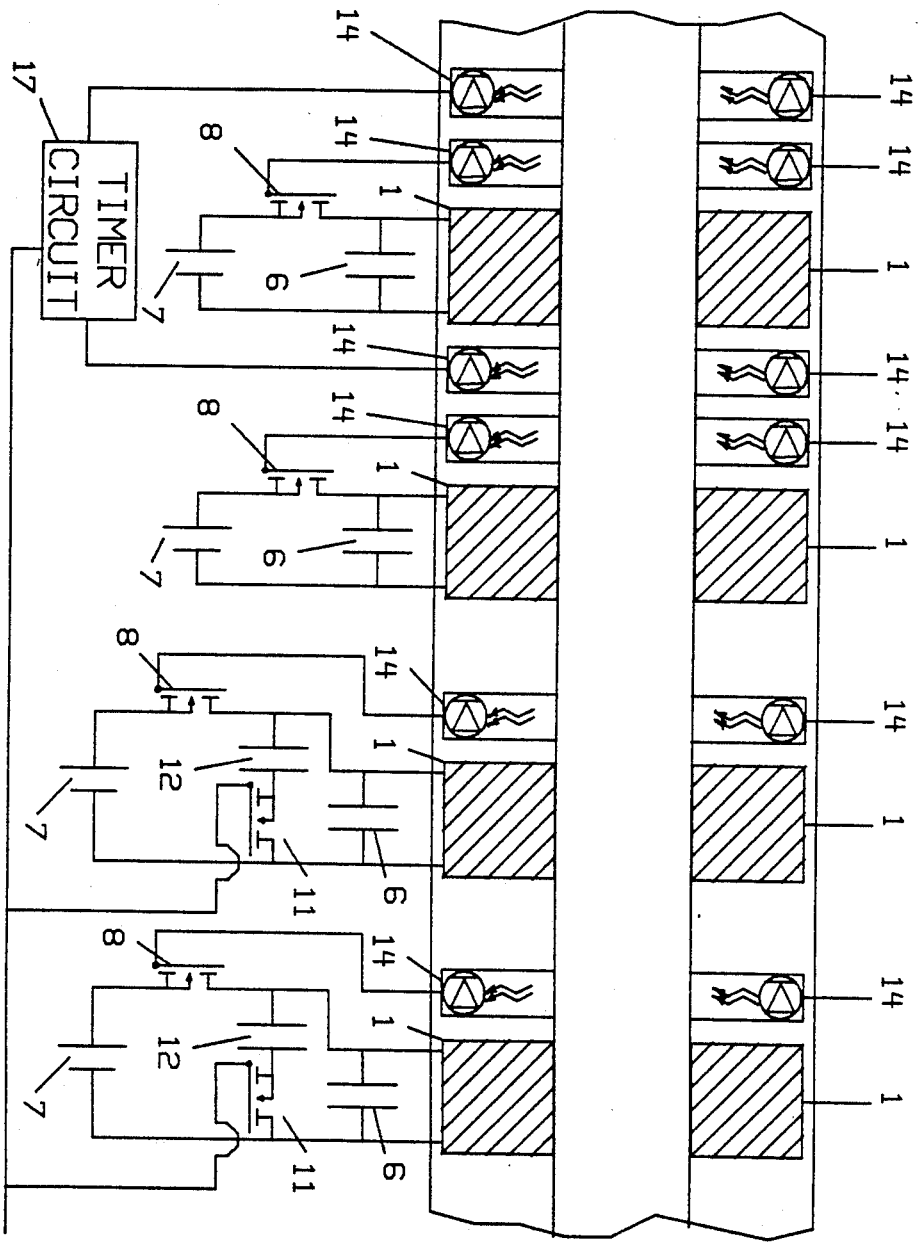
In FIG. 6 we show a simplified wiring diagram of a propellant coil.

FIG. 6 shows electronic circuitry to generate the drive field in propellant ring 1 in beginning end of the gun barrel like launcher with capacitor 6 in parallel with the propellant ring 1. Both the propellant ring and the capacitor 6 are charged by the battery 7 when nano-second switch 8 is closed. Switch 8 is activated by a photoelectric cell whenever the tip 23, FIG. 2, breaks a light beam in the photoelectric cell. In propellant rings in the outlet half of the assembly an auxiliary capacitor 12 with a switch 11 is connected in parallel with leads to the propellant rings 1.

Two photoelectric sensing switches are connected with timer circuitry 17 to measure velocity as the cylindrical launch container 9, FIG. 2, moves through the propellant rings 1. Timer circuitry 23 outputs a signal to close switch 11 if the velocity is lower than a preset speed. It is also possible to have a multiplicity of coils in an exit end of the structure that may be activated only when the measured velocity is such that these extra coils will accelerate the launch container to launch velocity. When switch 11 is closed on a plurality of rings and with capacitor 12 of a properly chosen size the propellant rings 1 then act to slow down the cylindrical launch container. In this manner the projectile or launch container 9 may be slowed to essentially a stop position. The rocket will continue burning but is sized to have very low thrust. The purpose of the rocket is to provide thrust when the cylindrical launch container 9 is in space. The size of the rocket compartment 15 and rocket strength may be varied.

Figure 7:
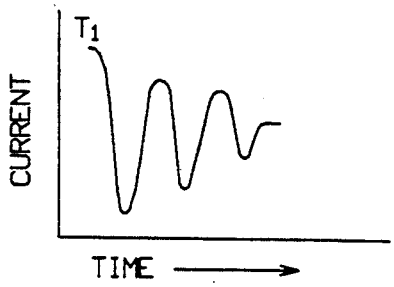
In FIG. 7 we indicate an oscilloscope graph of current flow induced when the nano-second switch 8.

FIG. 7 shows current variation with time when nano-second switch 8 is opened in a circuit as shown in FIG. 6 after the battery 7 has charged both the coil 1 and capacitor 6. By decreasing the size of the capacitor 6 the time between current pulses or frequency is increased. Thus, with multiple driver or propellant rings 1, FIG. 1, the capacitor for each successive ring is decreased in size to properly match the arrival of the second magnetic ring 16, FIG. 2.

The invention comprises a method to use a propellant fuel which may be a rocket plus explosive charge for initial acceleration of a cylindrical container 9 FIG. 1 with electromagnetic forces around propellant ring 1, FIG. 1, increasing acceleration to desired velocity while propellant fuel continues to burn and with final acceleration into orbit being provided by continued thrust from propellant fuel and momentum of unburned propellant fuel combined with inertia of the cylindrical container 9. Both inertial guidance 18 and remote controlled guidance means 19, FIG. 2 may be contained in the cone shaped nose of the cylindrical launch container 9 which holds both a payload and the propellant fuel compartments one of which contains initial propellant or rocket fuel and a second of which may contain retro-rocket fuel to be fired on return.

In one embodiment four thermopile ring bands 16, each made up of eight segments, are spaced apart 0.17 diameters of the propellant rings 1, FIG. 1. In other embodiments a minimum of two thermopile rings may be used. In a preferred embodiment alternate segments of the thermopile are made up of nickle and aluminum. One of a group comprising copper, aluminum, brass and iron and one of a group comprising nickle, constantan, and ALUMEL, aluminum alloy could be used. Choice is based on need for maximum conductency, maximum voltage and minimum weight.

When ablative tip 23 passes between electromagnetic propellant rings 1 a nano-second switch, such as a power Mos-Fet switch 8, FIG. 1, is opened by action of an activator means which may be a photo-electric cell 14, FIG. 1. Other means of activation such as a capacitance means or laser beam means could also be used.

Calculations indicate that with less than 30 electromagnetic propellant rings 1 and using four thermopile magnetic force generating rings around a cylindrical launch container that when capacitors 6, FIG. 1 are properly sized to vary the frequency of the current as shown in FIG. 7 to make maximum use of stored electrical energy, launch velocities of 5 miles per second or more may be reached. Maximum use occurs when N-S, S-N, N-S, etc., magnetic force interaction is such that the first pulse as shown in FIG. 7 acts to "push" the first thermopile ring 16 while pulling the second thermopile ring and the second pulse acts to "push" the second thermopile ring while pulling the third ring and the third pulse acts to "push" the third thermopile ring, etc. As the cylindrical container increases in velocity the second ring comes into the force field generated by the propellant rings more rapidly. Therefore, for maximum efficiency the frequency of the generated current must increase as the velocity of the cylindrical container increases. This frequency may be increased by reducing the size of the capacitor 6. With the assembly as outlined nearly constant acceleration may be achieved. Calculations would indicate some small efficiency increase by varying the spacing of the second, third and fourth thermopile rings on the cylindrical launch container.

Each segment of a thermopile ring may be made from strips of copper and nickel with ends joined. One junction 30, FIG. 5, may be cooled with liquid nitrogen and the other junction 31, FIG. 5, heated to about 300 degrees C with electrical resistance heaters. The segmented rings are alternately "flipped over" on the cylindrical launch container to form a N-S, S-N, N-S, S-N magnetic force field, with the continuous magnetic force ring being maintained until the ends of the thermopile approach ambient temperature. With launch velocities in the range of five miles per second the cylindrical launch container should reach orbit of 125 miles or more, with residual energy available to power a guidance system. However, use of silicon wafers, gallium arsenide wafers, or other sunlight to electricity converters on the surface of the cylindrical launch container or projectile are also possible.

One possible guidance system is formed by three retractable fins 10 that act to change the shape of conical nose 10. These fins may be powered by repelling and attracting electromagnetic coils receiving energy from the thermopile rings with an inertial or remote activation of an on-board microprocessor to direct changes in the retractable fins. Photocell 13 provides electricity for re-entry control.

Obviously many variations may be made in the structures we've outlined, depending the specific purpose, for example: (1) a forward compartment of cylindrical launch container structure could contain a warhead to explode on impact or to explode at a set time to throw out a shrapnel screen, or (2) the forward compartment could contain material to be transported to a space station and the rearward fuel containing compartment could be automatically separated as the fuel supply is exhausted and various other propellant means located in a compartment forward of the fuel compartment could then be activated. We therefore wish to be limited only as to the general aspects of the various components as outlined for this fuel assisted electromagnetic launcher as given in these claims and specifications.

What is claimed is:

1. A fuel assisted electromagnetic launcher comprising:

a) a D.C. power source, b) a minimum of three propellant coils means each with a central opening, and each with an external series connection to said D.C. power source, c) a nano-second switch means located in said external series connection, d) a first capacitor means connected in parallel with lines leading to each of said minimum of three propellant coil means, e) a primary activation means to open said nano-second switch means as a forward tip of a cylindrical launch container means approaches said each of a minimum of three propellant coil means; said cylindrical launch container means having one con shaped end with said cone shaped end having a pointed end means and with a minimum of two thermopile ring means around said cylindrical launch container means and with said cylindrical launch container means containing a rocket fuel in a rearward compartment of said cylindrical launch container means and with said pointed end means interacting with said primary activation means to time activation of each of said propellant coil means to interact with said minimum of two thermopile means to constantly accelerate said cylindrical launch container means after said cylindrical launch container means is propelled by ignition of said rocket fuel into a gun barrel-like structure means holding said minimum of three electromagnetic propellant coils means;

f) a thermopile activation means in a structure to contain said cylindrical launch container means and align said cylindrical launch container means with an interior of said gun barrel-like structure;

g) a remote controlled guidance means in said cone shaped forward end of said cylindrical launch container means, said guidance means being furnished power by one of a group comprising said thermopile means, silicon wafer generation means, and gallium arsenide generation means.

2. A fuel assisted electromagnetic launcher as in claim 1 where each of said propellant coils means comprises a multi-turn primary winding of an insulated wire forming a doughnut-like structure.

3. A fuel assisted electromagnetic launcher as in claim 1 where said primary activation means comprises a light source and a receptor connected with said nano-second switch means and acts to open said nano-second switch means when a beam from said source to said receptor is interrupted.

4. A fuel assisted electromagnetic launcher as in claim 1 wherein:

a) a plurality of propellant coil mean located following said minimum of three propellant coil means have said first capacitor means connected in parallel with each of said propellant coil means and a second capacitor connected in a series with a switching means, with both said second capacitor means and said switching means connected in parallel with each of said plurality of propellant coil means;

b) a secondary activation means to sense velocity of said cylindrical launch container means with associated circuitry to close said switching means connected in series with said second capacitor means if said velocity is lower than a preset value; said second capacitor means being properly sized to allow said plurality of propellant coil means to decelerate said cylindrical launch container means to abort a launch of said cylindrical launch container means.

5. A fuel assisted electromagnetic launcher as in claim 1 where said cylindrical launch container means is a non-magnetic material, has a diameter to fit into said gun barrel-like structure, has said rearward compartment to contain said rocket fuel, has a compartment for retro-rocket fuel, has a forward compartment to contain a payload, has said remotely controlled guidance means in said cone shaped end means and where said cone shaped end means has a forward tip of an ablative material, and has said minimum of two thermopile rings embedded in said non-magnetic material forming said cylindrical launch container means.

6. A fuel assisted electromagnetic launcher as in claim 1 where said thermopile activation means in said structure to contain said cylindrical launch container means comprises a multiplicity of heater means that function to heat a first end of thermocouple junctions that make up each segment of said thermopile ring means and further comprises a multiplicity of cooling means that function to cool a second end of said thermocouple junctions that make up each segment of said thermopile ring means.

7. A fuel assisted electromagnetic launcher as in claim 1 where said gun barrel-like structure means is formed by spacers between each of said minimum of three propellant coil means.

8. A fuel assisted electromagnetic launcher as in claim 1 where said remote controlled guidance means comprises a minimum of three retractable projection means located in said cone shaped end; said retractable projection means being powered by residual energy in said minimum of two thermopile ring means, with said residual energy being directed to electromagnetic attraction and repulsion coils as indicated by remotely generated signals.

9. A fuel assisted electromagnetic launcher comprising:

a) a D.C. power source;

b) a multiplicity of doughnut shaped electromagnetic propellant ring means having a rectangular cross section and chargeable from said D.C. power source and arranged in a gun barrel-like structure with each of said multiplicity of doughnut shaped electromagnetic propellant ring means being potted in a reinforced resin and being held a minimum distance apart equal to seventeen hundredths (0.17) of a mean diameter of said multiplicity of doughnut shaped electromagnetic propellant ring means by spacer means to form said gun barrel-like structure;

c) capacitors connected in parallel and nano-second switch means connected in series with said D.C. power source for each of said multiplicity of doughnut shaped electromagnetic propellant ring means; starting at a beginning end of said gun barrel-like structure said capacitors successively being of reduced capacity to increase the frequency of the ringing type circuit caused when said nano-second switch means are opened;

d) activation means located between each of said multiplicity of doughnut shaped electromagnetic propellant ring means to activate said nano-second switches means;

e) a cylindrical launch container means with a cone shaped forward end and a minimum of one compartment to contain a solid propellant fuel in a rearward end;

f) an ablative elongated tip means with a base attached to said cone shaped forward end and that functions to trigger said activation means to open said nano-second switch means;

g) a magnetic force generating means around said cylindrical launch container means that interacts to make maximum usage of alternating forces of said ringing type circuit generated by each of said multiplicity of doughnut shaped electromagnetic propellant rings means when each of said nano-switch means is opened by interaction of said activation means and said ablative elongated tip means when said cylindrical container means is propelled into said gun barrel-like structure by ignition of said solid propellant fuel.

10. A fuel assisted electromagnetic launcher as in claim 9 where said D.C. power source is one of a group comprising batteries, homopolar generators, and A.C. to D.C. convertors.

11. A fuel assisted electromagnetic launcher as in claim 9 where said magnetic force generating means around said cylindrical launch container means comprises a minimum of 2 segmented thermopile ring band means spaced apart a minimum of 0.17 times an outside diameter of said electromagnetic propellant ring means with said cylindrical launch container means being held in alignment with an opening in said gun barrel-like structure by a containment structure that further comprises a heating means and a cooling means to heat and cool alternate junctions of dissimilar metals forming said segmented thermopile ring band means.

12. A fuel assisted electromagnetic launcher as in claim 9 where each of said electromagnetic propellant ring means comprises:

a) a coil formed by a multiplicity of turns of an electrical conductive wire coated with an insulator and wound to form a rectangular cross section;

b) one of said capacitors connected in parallel with said coil and said nano-second switch means connected in series with said D.C. power source and said coil, said capacitor connected with said coil being varied in size to produce a variable frequency magnetic flux that allows maximum acceleration of said cylindrical container means when said nano-second switch means is activated by said ablative tip means.

13. A fuel assisted electromagnetic launcher as in claim 11 where said cooling means is chosen from a group comprising dry ice, liquid nitrogen, FREON, Fluorocarbon and liquid ammonia and where said heating means is chosen from a group comprising an electrical heater and a fuel fed flame.

14. A fuel assisted electromagnetic launcher as in claim 9 where said D.C. power source comprises a multiplicity of batteries.

15. A fuel assisted electromagnetic launcher as in claim 9 wherein each of said capacitors in a portion of said multiplicity of doughnut shaped electromagnetic propellant ring means is an exit end of said gun barrel-like structure are augmented with a second capacitor connected through a normally open switch in series with said capacitor, said switch being closed by action of a velocity measuring means in a beginning end of said gun barrel-like structure when said velocity measuring means indicates that velocity of said cylindrical launch container means is less than a preset velocity; said second capacitors are sized so that said cylindrical launch container is then slowed down to abort a launch.

16. A fuel assisted electromagnetic launcher as in claim 9 wherein said velocity means activates switching means to deactivate a portion of said multiplicity of doughnut shaped electromagnetic propellant ring means in an exit end of said gun barrel-like launcher when a preset velocity is attained.

* * * * *